United States Patent [19]

Wolf et al.

[11] Patent Number: 4,796,674

[45] Date of Patent: Jan. 10, 1989

[54] SHED-FORMING APPARATUS FOR DOUP WEAVE

[75] Inventors: Rudolf Wolf, Lenzing; Kurt Vilsecker, Gmunden, both of Austria

[73] Assignee: Lenzing Aktiengesellschaft, Lenzing, Austria

[21] Appl. No.: 91,933

[22] Filed: Sep. 1, 1987

[30] Foreign Application Priority Data

| | | | |
|---|---|---|---|
| Sep. 1, 1986 | [AT] | Austria | 2354/86 |
| Jul. 7, 1987 | [AT] | Austria | 1712/87 |
| Aug. 13, 1987 | [AT] | Austria | 2048/87 |

[51] Int. Cl.[4] ..... D03D 37/00

[52] U.S. Cl. ..... 139/13 R; 139/50

[58] Field of Search ..... 139/48, 49, 50–54, 139/13 R

[56] References Cited

U.S. PATENT DOCUMENTS

| | | | |
|---|---|---|---|
| 1,757,947 | 5/1930 | Snow | 139/50 |
| 2,830,623 | 4/1958 | Masson et al. | 139/54 |

FOREIGN PATENT DOCUMENTS

| | | | |
|---|---|---|---|
| 582064 | 11/1946 | United Kingdom | 139/50 |
| 648846 | 1/1951 | United Kingdom | 139/50 |

*Primary Examiner*—Henry S. Jaudon

*Attorney, Agent, or Firm*—Fleit, Jacobson, Cohn & Price

[57] ABSTRACT

A shed-forming apparatus for doup weaves comprises for each warp thread pair a plate adapted to be pivoted back and forth and comprising on one side of its pivoting axis a bore for the passage of the stationary warp thread and on the opposite side of its pivoting axis slot for accommodating the wip thread. Two or more plates are connected to one another as well as to drive discs by bolts or the like positioned radially outwardly beyond the slot, the drive discs being in turn engaged by a drive rod of the shed-forming mechanism. The peripheral shape of the plates may be elliptical or ellipsoidal or it may be circular. The drive discs may also take the form of belt-driven cog wheels engaging matching teeth of a toothed belt connected to the drive means for the shed-forming plates.

11 Claims, 5 Drawing Sheets

SHED-FORMING APPARATUS FOR DOUP WEAVE

BACKGROUND OF THE INVENTION

The invention relates to a shed-forming apparatus for producing a doup weave comprising at least one shed-forming plate provided with a slot for the wip thread and a bore for the stationary thread and adapted to be pivoted back and forth, its pivoting axis being substantially normal to the warp threads and essentially parallel to the warp plane. Such shed-forming apparatus is described in essence in FR-PS No. 952 085 (Ibanez).

OBJECTS OF THE INVENTION

It is an object of the invention to design such shed-forming apparatus in as simple as possible a manner such that a comparatively large part of the width of the fabric or the fabric over its entire width can be manufactured in doup weave fashion, or respectively in the context of circular weaving looms, that the tubular fabric manufactured on such machines comprises an uninterrupted doup weave over its entire circumference.

In particular, in the context of bags manufactured from tubes of appropriate diameter by cross sewing and cutting, it is highly desirable that the tubular wall is air-pervious and thus has a coarse meshed, sieve-like texture; however, at the same time, the yarns of the tube wall—warp threads extending in the longitudinal direction of the bag and weft yarns extending circumferentially—are required to be adequately secured against displacement in order to avoid the inadvertent formation of holes by localized mutual displacement of the yarns and the resultant dropping out of the contents (potatoes, onions, nuts or the like) from the bag. However, on the other hand, it should remain possible to create holes intentionally in any locality of the bag wall by shifting yarns with appropriate application of force, e.g., in order to take samples, to be able to remove spoilt parts of the bag contents (rotting potatoes and the like), and to close again such holes by pushing back the yarns into their original positions.

GENERAL DESCRIPTION OF THE INVENTION

In order to attain the aforesaid advantages, provision is made according to the invention, in shed-forming apparatus of the type defined in the introduction, for two or more shed-forming plates to be rigidly interconnected by bolts or the like positioned radially outwardly beyond the slot.

Preferably, at least one shed-forming plate is connected by the bolts or the like to at least one drive disc. Advantageously, the drive disc comprises a pivot means for its connection to a drive rod and carries an axle pin for its pivotal mounting in the machine structure, and the pivoting axis of the plates is disposed between the slot and the bore. Preferably, the axis of the bore for the stationary warp thread, the axes of the bolts and the pivoting axis are essentially in a common plane.

In a specific embodiment, at least two shed-forming plates are rigidly interconnected by bolts positioned outwardly beyond the slot and at least one shed-forming plate is connected to a drive disc in the form of a cog wheel driven by a toothed belt.

BRIEF DESCRIPTION OF THE DRAWINGS

Further features of the apparatus according to the invention are explained in the following with reference to the drawings which illustrate a preferred working example as applied to a circular loom. In that context.

DESCRIPTION OF SPECIFIC EMBODIMENTS

Figure 1:
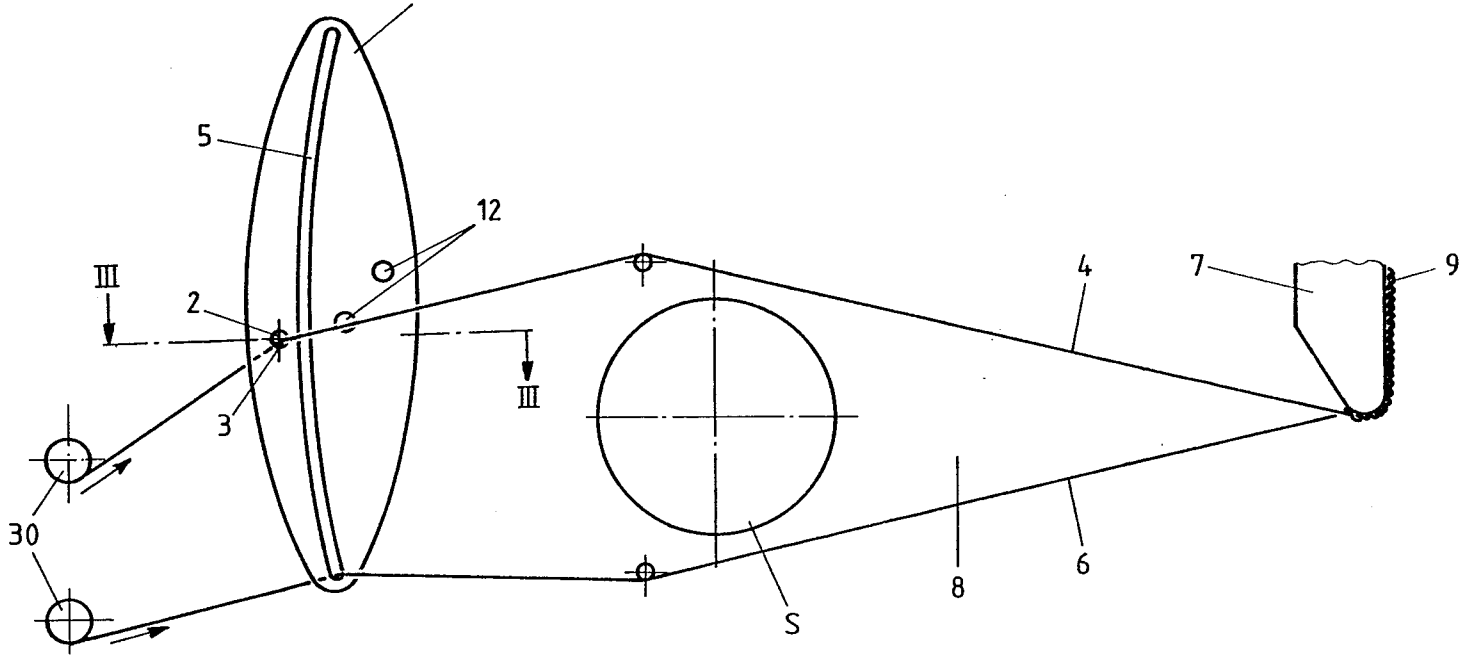
FIG. 1 illustrates the principle underlying the apparatus according to the invention.

In FIG. 1, the shed-forming disc is denoted as 1. It has an approximately elliptical circumference and is pivotal about an axis 2. Of course, it may also be of circular or other shape, e.g., angular configuration. On one side of the axis 2, it comprises a bore 3 for the stationary warp thread 4 and on the other side of the axis 2 it comprises a slot 5 for the wip thread 6 of the warp. The warp threads 4 and 6 are derived in the direction of the arrows drawn in FIGS. 1 and 7 from warp beams or spindles which are not illustrated and in the embodiment illustrated they proceed to the lower edge of the deflecting or bag ring 7 of a circular loom. The tubular fabric 9 formed by inserting the weft yarns by the shuttle in the respectively open shed 8 is deflected upwardly and is, for example, rolled up after being laid flat.

Figure 2:
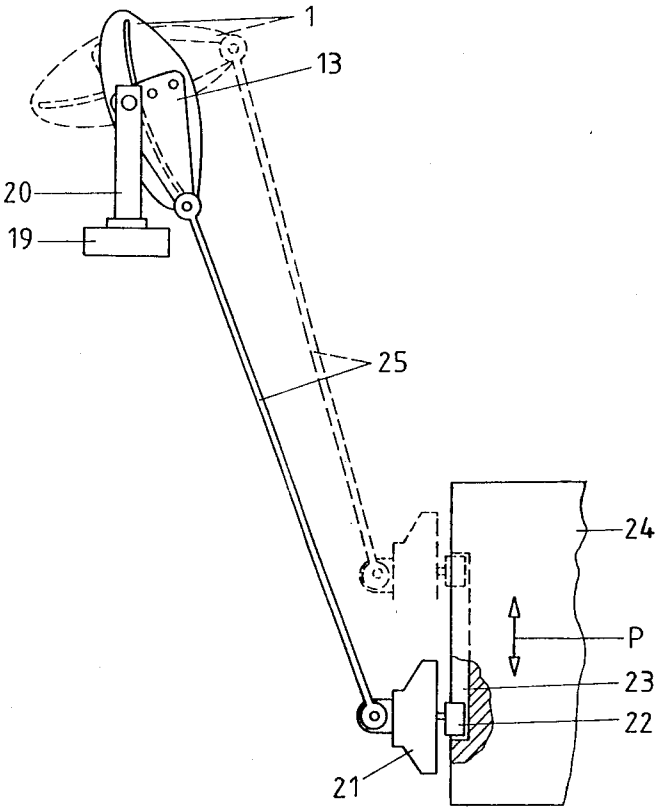
FIG. 2 illustrates a doup weave shed-forming apparatus viewed sideways (viewed in the weft direction).
Figure 5:
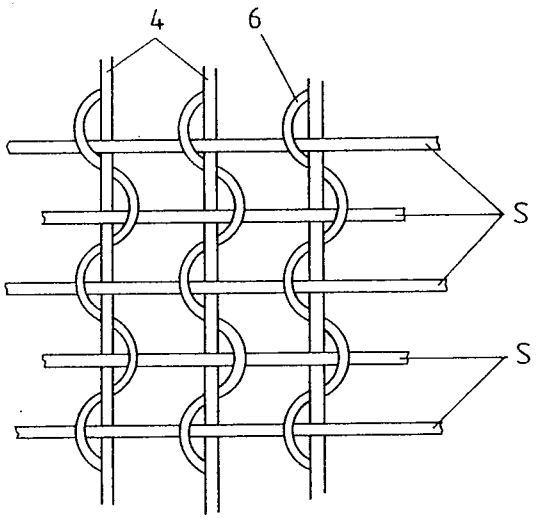
FIG. 5 shows a doup fabric manufactured with an apparatus according to the invention.

The two warp threads 4 and 6 which, in FIG. 1, come in from the rear of the shed-forming plate 1, have passed through the bore 3 or respectively through the slot 5 to form a shed 8 in the terminal position of plate 1 as illustrated in FIG. 1 which is limited above by the stationary yarn 4 and below by the wip thread 6 which, as illustrated in FIG. 1, lies behind the thread 4. After the entry of the weft yarn S, the plate 1 is turned by at least 90° counterclockwise by the control device still to be described—The position then taken by plate 1 is illustrated in broken lines in FIG. 2. The wip thread 6 is first lifted and raised above the stationary thread. Approximately midway through the pivoting movement of plate 1, wip thread 6 crosses over stationary thread 4. At the end of the pivoting movement of the plate 1, wip thread 6 has slid to the opposite end of the slot 5 and once again forms the lower limitation of the shed 8, but now lies in front of the stationary thread 4. In doing so, it has carried out a "twist," preferably a "half-twist," and after the insertion of the weft yarn S into the shed 8 is moved again to the other side of the stationary yarn. This causes the formation of a doup fabric as illustrated in FIG. 5.

Figure 3:
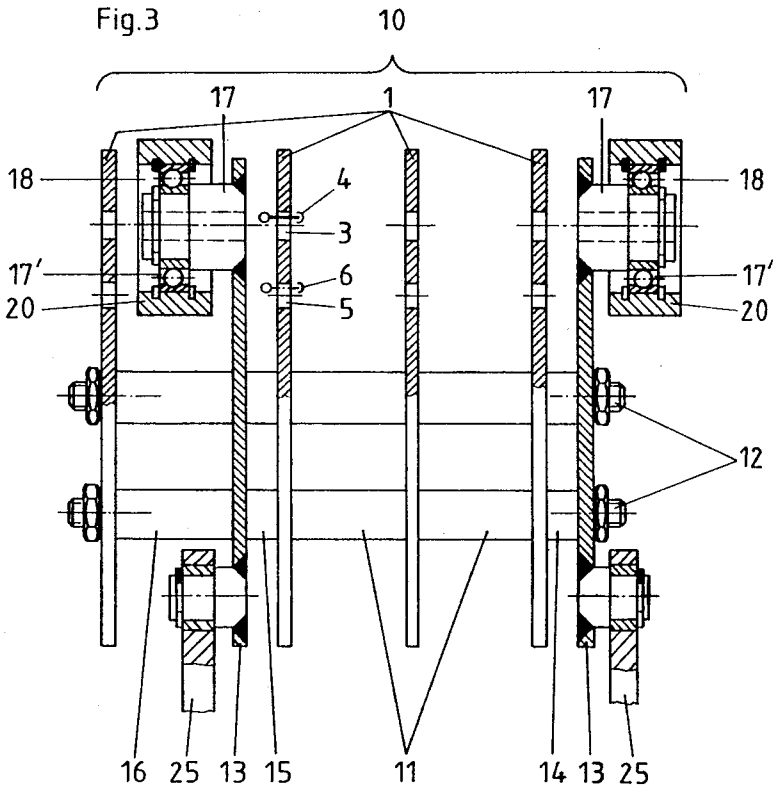
FIG. 3 shows a section along line III—III of FIG. 1.
Figure 4:
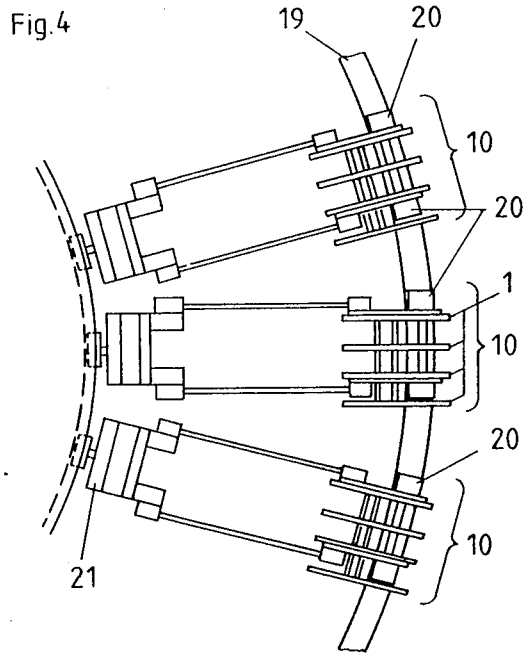
FIG. 4 shows a plan view.

For the production of tubular fabrics in doup weave on circular looms, pluralities of shed-forming plates 1 are assembled in groups 10. The interconnection of the plates 1 is, for example, brought about by spacer members 11, radially outwardly positioned of the slots 5 of the plates 1 and, for example, connected by means of threaded bolts 12 (FIGS. 1, 3A) to the plates 1 (in FIGS. 3 and 4, for example, four per group 10). It should be clear from FIG. 4 that groups 10 may positioned concentrically at angular locations around the rotating axis of a drum of a circular loom and connected to the drum in a manner which will be described. For pivotal mounting and driving, two drive discs 13 are provided in the illustrated working example which are located by virtue of a shorter spacer member 14 outwardly of the discs 1 and which by the use of partial spacer members 15, 16 instead of a spacer member 11 are accommodated between two plates 1. The four plates 1, the two drive discs 13 and the spacer members 11, 14, 15, 16 thus are combined in a single rigid structure. From each drive disc 13, a pivoting pin 17 projects. These pivoting pins are mounted in bores 18, e.g., by means of ball bearing 17' of supports 20 fixed to the loom structure 19.

For driving the twist device, each group 10 comprises a slider means 21 which is movable up and down in the loom structure (arrow P) along guide means, which are not illustrated, comprising a guide roller 22, preferably a sliding block which engages into the guide groove 23 of the grooved drum 24 of the circular loom. The shed-forming plates 1 are pivoted back and forth by control rods 25 linked at one end to the slider means 21 and at the other end to the drive discs 13, and thus the doup fabric is formed in the manner already described.

The peripheral configuration of the plates can be selected optionally and may be elliptical or ellipsoidal as illustrated or in its simplest form may be circular.

Figure 6:
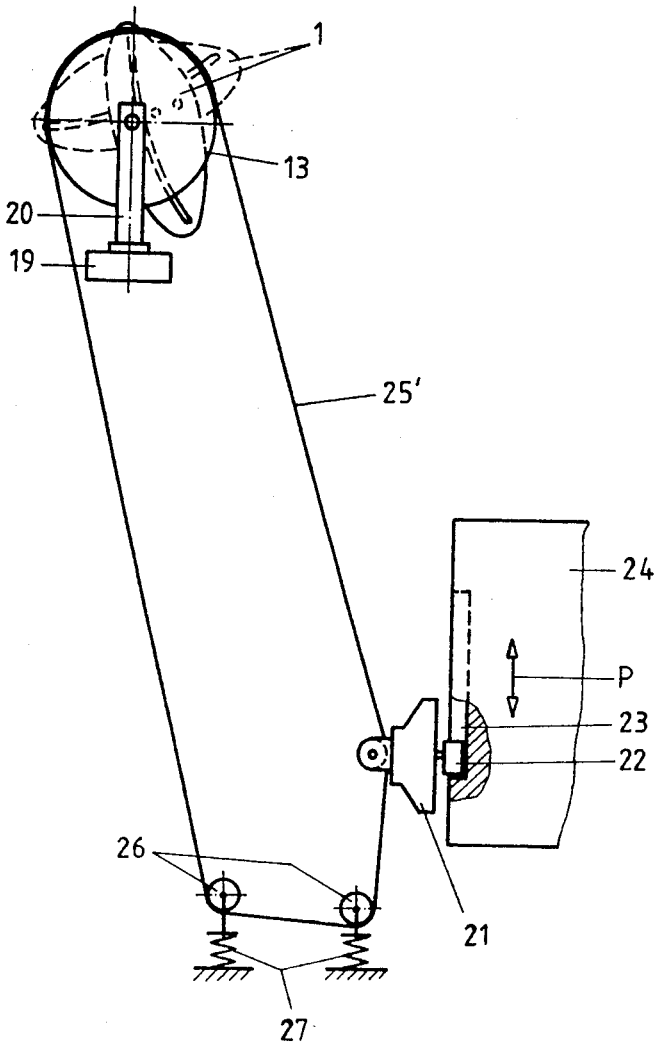
FIG. 6 shows a further embodiment of the subject in accordance with FIG. 2.

Naturally, a variety of modifications are possible within the scope of the invention. Thus, it is possible for the drive disc 13 to take the form of a cog wheel as shown in FIG. 6 which meshes with a toothed belt 25' which, on the one hand, is fixed to the slider member 21 and, on the other hand, embraces the cog wheels 13 over about half their circumferences, meshing with the teeth thereof. This causes the shed-forming plates 1 to be pivoted to and fro, causing the formation of the doup fabric as described further above. In this context, the toothed belt is fixed to the slider member 21 and guided over return rollers 26 acted upon by springs 27 whereby the belt 25' is always kept tight.

It is furthermore possible to provide the cog wheel only with teeth over that peripheral region which enters into contact with the toothed belt, and vice versa the toothed belt 25' need only be provided with teeth over that part of its length which has to mesh with the teeth of the cog wheel.

It is furthermore possible to provide the shed-forming plates 1, in particular, if they are of circular configuration with toothed formations on their peripheries or such parts thereof which mesh with the teeth of the toothed belt 25'. In that case, the drive discs 13 may be dispensed with and preferably the marginal shed-forming plates 1 of the groups 10 will then carry the axial pins 17 which are mounted in the supports 20.

Figure 7:
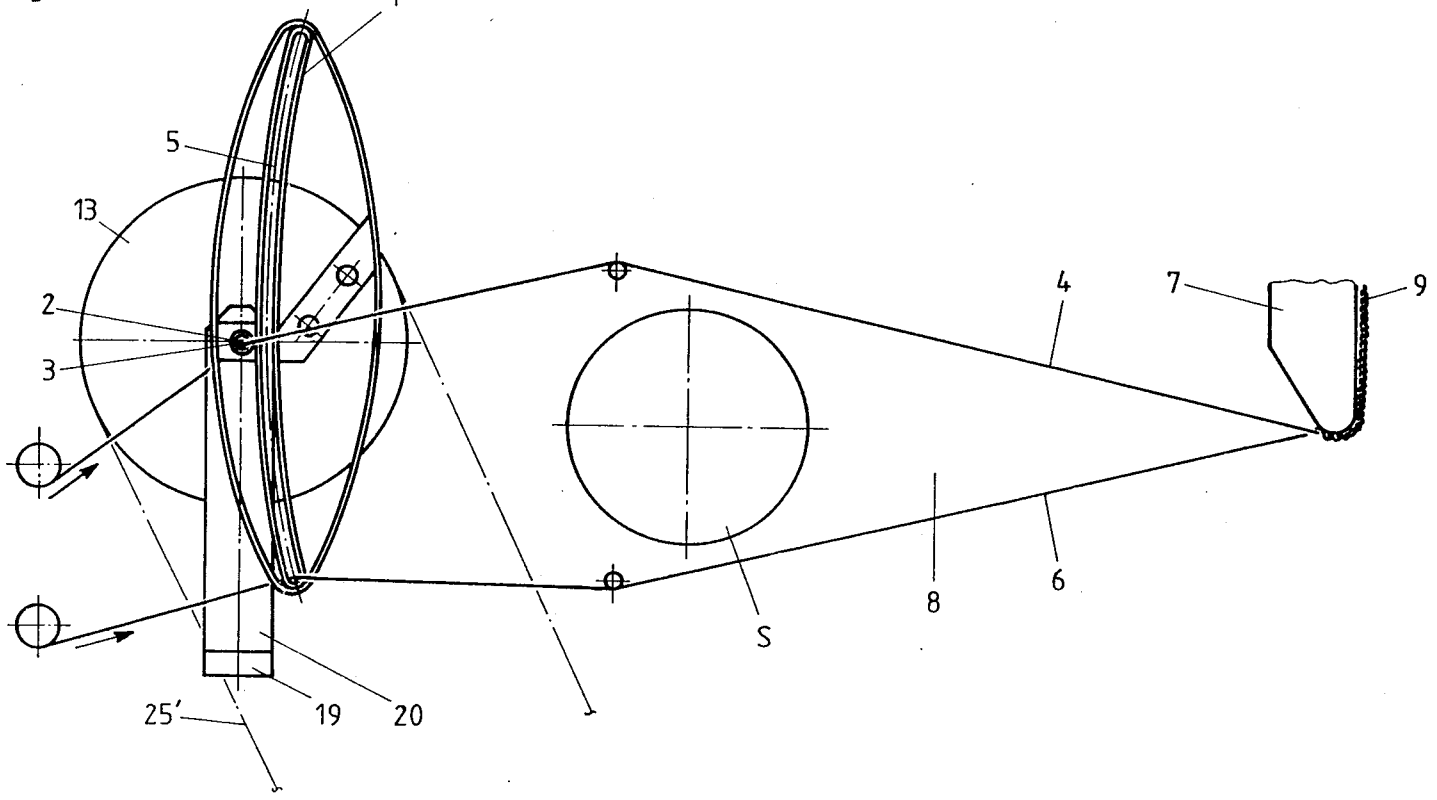
FIG. 7 shows a further embodiment of the shed-forming disc in accordance with FIG. 1.

The shed-forming disc 1 can have the form of a wire frame as shown in FIG. 7 which encloses or defines a slot 5 for the wip thread and has an elliptical circumference and is pivotal about the axis 2. The frame is in the form of a wire from which lateral tongues 1', 1'' project, one of which, e.g., 1', carries the axis 2 and has a bore 3 for the stationary thread 4. The frame 1 can be enclosed by stiffening wire frame IA, which can have an elliptical, circular or other form, e.g., angular configuration, and is connected with two opposite points, e.g., in case the frames 1, 1A have an elliptical shape, at the narrow sides as designated by points lB. In this case, the tongues 1', 1'' extend preferably between both frames 1, 1A; however, they may laterally project beyond frame 1A, too. The frame 1A is preferably composed, as is frame 1, of a suitable resistant wire.

It is further possible to provide a belt-drive cog wheel which is connected or coupled with the shed-forming disc and which is meshing with the toothed belt 25' instead of providing the shed-forming disc as including a cog wheel.

What we claim is:

1. Shed-forming apparatus for producing a doup weave comprising shed-forming means, each of said shed-forming means provided with a slot for accommodating and lifting a wip thread and a bore for accommodating a stationary thread and adapted to be pivoted back and forth, about a pivoting axis substantially normal to the wip thread and the stationary thread and essentially parallel to a warp plane, at least two of said shed-forming means being rigidly interconnected at positions located outwardly of the slot to a group of said shed-forming means, a plurality of groups being positioned concentrically and at angular locations around a rotating axis of a drum of a circular loom and connected to the drum so that each of said groups are pivoted by rotation of said drum.

2. Apparatus according to claim 1, wherein the shed-forming means consists of at least one shed-forming plate of elliptical peripheral configuration connected to at least one drive disc, which includes a pivot for connection with a drive rod and carries an axle pin for pivotal mounting.

3. Apparatus according to claim 2, wherein the pivoting axis of the plates is disposed between the slot and the bore.

4. Apparatus according to claim 1, wherein the bore for the stationary warp thread is disposed in the region of the pivoting axis of said shead-forming means.

5. Shed-forming apparatus for producing a doup weave comprising shed-forming places, each provided with a slot for accommodating a wip thread and a bore for accomodating a stationary thread and adapted to be pivoted back and forth, about a pivoting axis substantially normal to the wip thread and the stationary thread and essentially parallel to a warp plane wherein two shed-forming plates are rigidly the slot, at least one shed-forming plate being connected to at least one drive disc, the drive disc including a pivot for connection with a drive rod and carrying an axle pin for pivotal mounting.

6. Apparatus according to claim 5, the shed-forming plates are of elliptical peripheral configuration.

7. Shed-forming apparatus for producing a doup weave comprising shed-forming plates, each provided with a slot for accommoduating a wip thread and a bore for accommodating stationary thread and adapted to be pivoted back and forth, about a pivoting axis substantially normal to the wip thread and the stationary thread and essentially parallel to a warp plane wherein two shed-forming plates are rigidly interconnected at positions located radially outwardly beyond the slot, at least two shed-forming plates being rigidly interconnected by bolts positioned outwardly beyond the slot and at least one shed-forming plate being connected to a drive disc in the form of a cog wheel driven by a toothed belt.

8. Apparatus according to claim 7, wherein said cog wheel carries teeth over at least part of its periphery adapted to mesh with matching teeth of the driven toothed belt.

9. Apparatus according to claim 7, wherein the toothed belt passes around spring-loaded deflecting rollers.

10. Shed-forming apparatus for producing a doup weave comprising comprising shed-forming plates, each providing with a slot for accommodating a wip thread and a bore for accommodating a stationary thread and adapted to be pivoted back and forht, about a pivoting axis substantially normal to the wip thread and the stationary thread and essentially parallel to a warp plane wherein two shed-forming plates are rigidly interconnected at positions located radially outwardly beyond the slot, the shed-forming plates including a first frame defining the slot for the wip thread and a second stiffening frame enclosing the first frame, at least one of said frames consisting of a wire.

11. Circular loom comprising a shed-forming apparatus for producing a doup weave comprising shed-forming places, each provided with a slot for accommodatng a wip thread and a bore for accommodating a stationary thread and adapted to be pivoted back and forth, about a pivoting axis substantially normal to the wip thread and the stationary thread and essentially parallel to a warp plane wherein at least two of the shed-forming plates are rigidly interconnected by bolts posiitoned radially outwardly beyond the slot, at least one of said shed-forming plates being connected to at least one drive disc, the drive disc including a pivot for connection with a drive rod and carrying an axle pin for pivotal mounting.

* * * * *